United States Patent [19]

Sullivan et al.

[11] 3,945,140

[45] Mar. 23, 1976

[54] CARD BOOK

[76] Inventors: James Patrick Sullivan, 1752 Brookshire Ave., Tustin, Calif. 92680; Dale D. Smith, 19391 Devry Drive, Irvine, Calif. 92664

[22] Filed: Nov. 18, 1974

[21] Appl. No.: 524,579

[52] U.S. Cl. ..... 40/102; 40/104.1

[51] Int. Cl.[2] ..... G09F 11/06

[58] Field of Search ..... 40/102, 104.03, 104.06, 40/104.1 L, 104.19, 64 R, 37, 37.1, 72.78, 104; 281/15, 24, 29, 21

[56] References Cited

UNITED STATES PATENTS

| | | | |
|---|---|---|---|
| 499,442 | 6/1893 | Rudolph | 40/64 R X |
| 2,167,578 | 7/1939 | Finch | 40/104.03 |
| 2,752,707 | 7/1956 | King | 40/104.1 Z |

*Primary Examiner*—John H. Wolff

*Attorney, Agent, or Firm*—Gary, Juettner et al.

[57] ABSTRACT

A pair of molded plastic covers are connected along one side by a hinge, and a plurality of cards are removably mounted in an overlapping relationship on the interior surface of each of said covers. The hinge comprises a post secured in a spaced relationship from an edge of each of the covers, and a double barrel member journalled on and hingedly connecting the respective posts. The surfaces on which the cards are mounted are molded with a concave configuration to allow the overlapping cards to lie flat. The cards are mounted on wire hangers which project into spaced grooves on the mounting surface.

6 Claims, 9 Drawing Figures

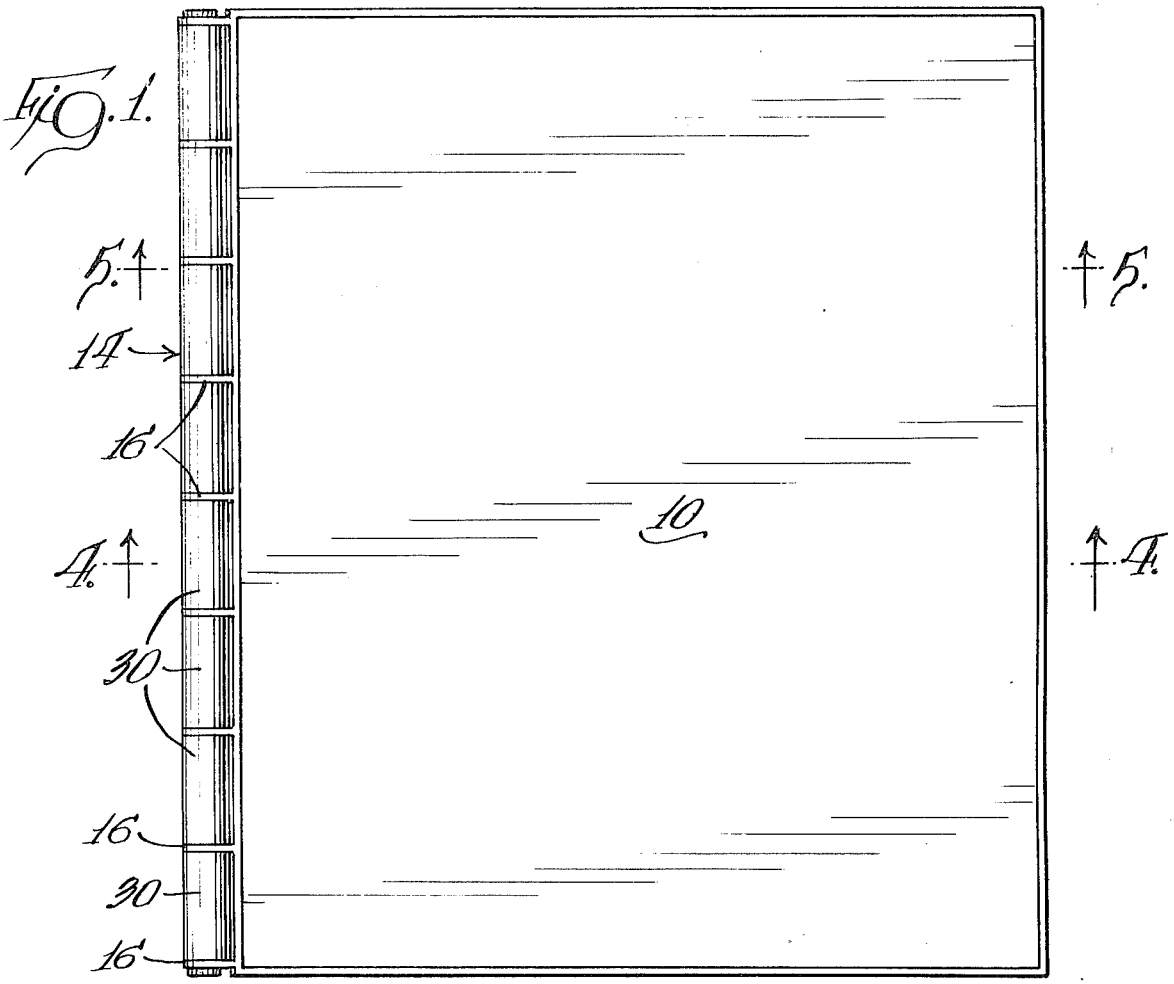
Fig. 1.
5.
5.
14
16
10
4.
4.
30
16
30
16
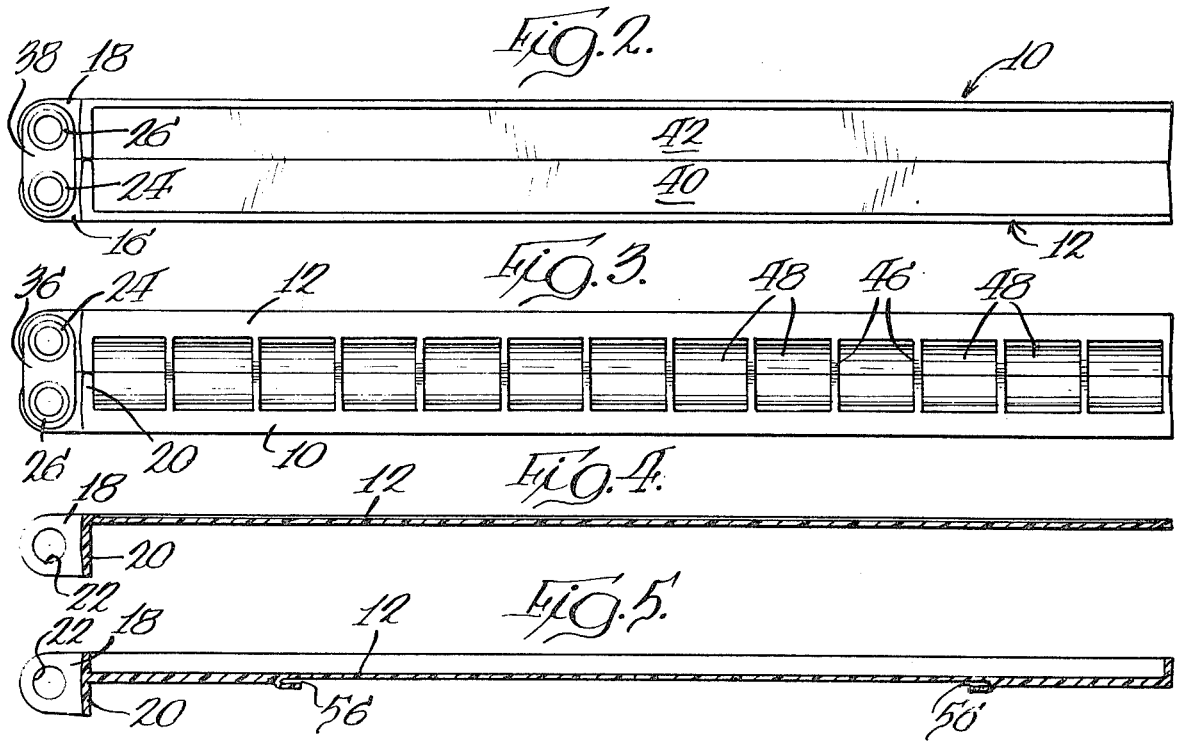
Fig. 2.
38
18
10
16
42
24
40
16
12
Fig. 3.
36
24
12
48
46
48
26
20
10
Fig. 4.
18
12
20
22
Fig. 5.
22
18
12
20
56
50

CARD BOOK

BACKGROUND OF THE INVENTION

This invention relates to improvements in card books of the type having two or more superimposed covers that are connected by a hinge on one side, together with means for mounting a plurality of cards or documents on the interior surface of one or both covers.

The Furlong U.S. Pat. No. 1,916,209 illustrates a card book of the general type described herein. The cards are mounted on a pair of hingedly connected covers in an overlapping relationship, so as to leave a margin of each card exposed and visible for easy identification. Various embodiments of card books are shown and described in the following U.S. Pat. Nos. 1,923,366; 1,957,800; 1,986,015; 2,140,926; 2,348,914; 2,610,421; 2,871,153; and 3,363,349.

In order to be practical, card books must be able to accommodate a large number of cards, which together weigh more than the book itself. Heretofore it has been necessary to construct the book covers from a metal such as aluminum and to connect the covers with metal hinges, which renders the book quite heavy, cumbersome and expensive. It would thus be desirable to reduce the weight and cost of the book by simplifying the design and by using less expensive materials, but without sacrificing quality or strength.

SUMMARY OF THE INVENTION

The present invention provides an improved card book wherein the covers and most of the hinge are fabricated from molded plastic parts. A hinge post is supported in a spaced relationship from an edge of each cover by a plurality of struts that are integrally formed with the covers. A plurality of double barrel pieces are journalled on the respective posts between the struts to complete the hinge. The covers are each molded in a single piece construction with a concave card mounting surface and parallel channels to allow the cards to be mounted on wire hangers in an overlapping relationship and yet lie flat.

More detailed features of the invention will appear hereafter in the specification, claims and annexed drawings.

THE DRAWINGS

FIG. 1 is an elevational view of the card book of the present invention;

FIG. 2 is a bottom end view of the book shown in FIG. 1;

FIG. 3 is a top end view of the book shown in FIG. 1;

FIG. 4 is a sectional view taken along section line 4—4 of FIG. 1;

FIG. 5 is a sectional view taken along section line 5—5 of FIG. 1.

DESCRIPTION OF THE PREFERRED EMBODIMENT

Figure 6:
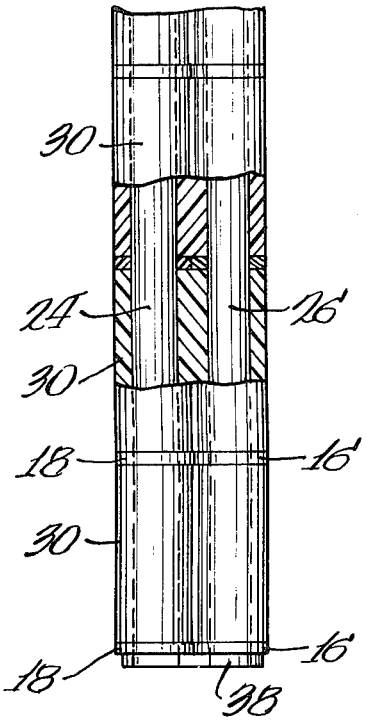
FIG. 6 is a fragmentary end view of the hinge end of the book shown in FIG. 1.

As shown in the Figures, the card book of the present invention generally comprises a pair of superimposed covers 10 and 12 connected together along adjacent edges by a hinge structure 14. The covers 10 and 12, except for being left and right handed, are substantially indentical and are molded from rigid plastic materials or polymers which may contain fillers and pigments. Each cover is formed with a plurality of struts 16 and 18 projecting from the edge of the cover on which the hinge 14 is to be formed. The struts 16 and 18 are spaced along the lengths of the respective cover edges, preferably equi-spaced, with a strut being located near each end. As shown in FIGS. 4 and 5, each strut, such as 18, is joined to an end wall 20 that is coextensive with the cover edge, and a circular aperture 22 is provided in each strut, said apertures being arranged along a common axis for each cover.

Cylindrical posts 24 and 26 extend through the apertures for respective groups of struts 16 and 18 of the covers, the struts serving to support the posts in a spaced relationship from the edge of the respective cover. The posts 24 and 26 are preferably hollow rigid tubes and are of a relatively large diameter in comparison with the thickness of the book. Preferably, the combined diameter of the two posts is in excess of 50% of the total book thickness, thereby providing large bearing surfaces for the hinge structure and providing for better stress distribution. As shown, the posts are substantially coextensive with the length of the covers.

Figure 8:
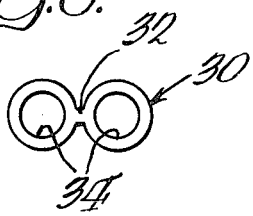
FIG. 8 is an end view of one of the double barrel hinge sections shown in FIGS. 1 and 6.

A plurality of double barrel members 30, having a cross section substantially in the form of a figure eight, are provided for hingedly connecting the posts 24 and 26 together between the struts 16 and 18. The double barrel members 30 may be of molded plastic, and as shown in FIG. 8, comprise a pair of cylinder sections secured together in a parallel relationship by a common joint 32. Each of the sections has an internal cylindrical bore 34 which has a diameter slightly greater than the diameter of the posts 24 and 26. The length of each of the members 30 is slightly less than the distance between adjacent pairs of struts 16 or 18.

The ends of the posts 24 and 26 are connected together beyond the outermost struts by means of flat double hole retainers 36 and 38, which prevent axial movement of the posts after installation. The edges around the holes of the retainers 36 and 38 are tapered to allow compression or rollswaged fitting. The retainers also provide protection for the book corners.

In order to assemble the hinge, the double barrel members 30 are positioned as shown in FIG. 1, and the posts 24 and 26 are simply threaded through the apertures of the members and struts, followed by installation of the retainers 36 and 38 at the ends. The members 30 and retainers 36 and 38 serve to maintain the posts 24 and 26 in a parallel relationship. The double post hinge also allows one of the covers to be pivoted approximately 360 degrees with respect to the other cover, which is a very useful feature when working in confined locations, i.e., the book may be opened with the covers back-to-back for arm-held reference or posting.

As shown in FIG. 2, the covers 10 and 12 are each provided with respective bottom walls 40 and 42 which abut when the book is closed. As shown in FIGS. 3 and 4, a molded plastic flat leaf 44 may be pivotally suspended from the top inside edge of one or both of the covers 10 and 12. As shown, a plurality of integrally molded spaced struts 46 are formed in a line across the top edge in the cover and a pin 47 is mounted through aligned apertures therein. The upper edge of the leaf 44 is formed with a plurality of integrally molded projecting eye sections or eyelets 48 which are journalled on the pin 47 between the struts. The leaf 44 serves to overlie and protect cards that are mounted in the book and may be pivoted upwardly when examining the cards.

Figure 7:
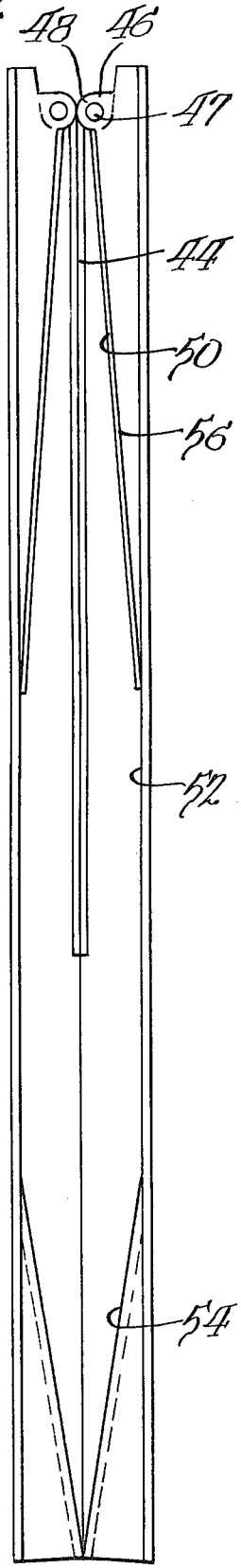
FIG. 7 is an end view of the end of FIG. 1 book opposite to the hinge.
Figure 9:
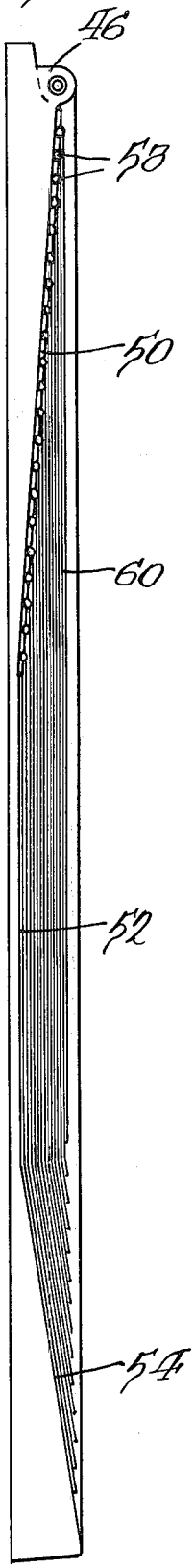
FIG. 9 is a side view of one of the covers of the book shown in FIG. 1, indicating the manner in which the cards are mounted therein.

As shown in FIGS. 7 and 9, the inside surface of each cover 10 and 12 is convex when viewed from the side, said surface comprising an inwardly inclined upper portion 50 merging with a level intermediate portion 52, which in turn merges with an outwardly inclined lower portion 54. The upper portion 50 is provided with a pair of integrally molded spaced channels 56 (see also FIG. 5), which extend parallel to the main hinge 14 and receive the projecting ends of wires 58 on which the cards 60 are mounted (FIG. 9). The use of wire mounted cards and suitable channels therefor are conventional and will not be described in detail.

The channels 56 extend along the length of the inwardly inclined upper portion 50, and the cards are mounted in a successive overlapping relationship therein from top to bottom, as shown in FIG. 9. The overlapping cards form a structure which is thick in the center and progressively thinner at both ends, due to the overlapping configuration, and the convex shape of the inside book surface allows the cards to lie flat when viewing their visible surfaces.

It may be seen that the card book construction described herein is an improvement over prior art devices in several respects. The pre-formed covers include integral portions of the hinge structure, thereby simplifying construction and eliminating the need for separately installed hinges. The covers and most of the hinge may be constructed from molded plastic, which is less expensive than materials in current use.

We claim:

1. A card book comprising a pair of rigid covers, means for holding a plurality of cards on a surface of at least one of said covers, and hinge means for connecting said covers along one respective adjacent edge thereof, said hinge means comprising a plurality of spaced apart apertured struts secured to and extending from each of said respective edges of said covers, a pair of cylindrical rigid posts supported within said struts on said respective cover edges, said posts being disposed in the apertures of said struts in a spaced relationship from said respective edges, means for retaining said posts in said strut apertures, and a plurality of integral cylindrical double barrel members, each barrel of each said member having a longitudinal cylindrical aperture, the apertures of each said member being arranged in parallel and being disposed around the posts of respective covers with said members positioned between opposite corresponding pairs of struts thereof, whereby one of said covers can rotate completely around the other of said covers.

2. The card book of claim 1 wherein each of said posts comprises a tube.

3. The card book of claim 1 wherein said means for holding a pluraltiy of cards comprises a pair of spaced channels on said surface substantially parallel with said hinge means, said surface comprising an inwardly sloping portion merging with flat intermediate portion, and an outwardly sloping portion merging with the opposite side of said intermediate portion, said channels being located on said inwardly sloping portion.

4. The card book of claim 3 wherein said covers and the surfaces thereof are formed of molded plastic material.

5. The card book of claim 1 wherein said struts and said covers are integrally formed molded plastic material.

6. The card book of claim 1 wherein a leaf is pivotally mounted on one of said covers and hinge means are provided for connecting said leaf to said cover, said hinge means comprising a plurality of spaced struts extending from the face of said cover and having aligned apertures, a plurality of eyelets extending from said leaf between said struts, and pin means extending through said apertures and said eyelets.

* * * * *